US005562037A

United States Patent [19]

Schleinz et al.

[11] Patent Number: 5,562,037

[45] Date of Patent: Oct. 8, 1996

[54] SINGLE SUBSTRATE, REPEAT-PASS PRINTING PROCESS

[75] Inventors: Robert J. Schleinz, Appleton, Wis.; Daniel J. Conrad, Murfreesboro, Tenn.; Joseph S. Kucherovsky, Philadelphia, Pa.

[73] Assignee: Kimberly-Clark Corporation, Neenah, Wis.

[21] Appl. No.: 347,981

[22] Filed: Dec. 2, 1994

[51] Int. Cl.[6] ..... B41F 13/54

[52] U.S. Cl. ..... 101/483; 101/417; 101/155; 101/228

[58] Field of Search ..... 101/228, 232, 101/416.1, 118, 483, 178, 417, 132, 153, 155, 156; 283/67, 27, 28, 66.1

[56] References Cited

U.S. PATENT DOCUMENTS

| | | | |
|---|---|---|---|
| H1376 | 11/1994 | Osborn, III et al. | 604/361 |
| 364,029 | 5/1887 | Macnab . | |
| 429,891 | 6/1890 | Crowell | 101/223 |
| 1,639,218 | 8/1927 | Ebersol | 101/416.1 |
| 2,111,613 | 3/1938 | Bulford | 101/178 |
| 2,175,051 | 10/1939 | Bromley | 101/178 |
| 2,378,444 | 6/1945 | Smith et al. | 101/228 X |
| 2,404,350 | 7/1946 | Carlsen et al. | 101/483 X |
| 2,504,021 | 4/1950 | Heinrich | 101/130 |
| 2,743,206 | 4/1956 | Verduin | 154/54.5 |
| 3,306,194 | 2/1967 | Cutri | 101/131 |
| 3,306,196 | 2/1967 | Cutri | 101/132.5 |
| 3,442,211 | 5/1969 | Beacham | 101/416 |
| 3,518,940 | 7/1970 | Stroud et al. | 101/223 |
| 3,978,789 | 9/1976 | Fennekels et al. | 101/211 |
| 4,063,505 | 12/1977 | Sasamoto et al. | 101/228 |
| 4,069,822 | 1/1978 | Buell | 128/294 |
| 4,147,580 | 4/1979 | Buell | 156/291 |
| 4,218,973 | 8/1980 | Bouffard et al. | 101/181 |
| 4,232,076 | 11/1980 | Stetson et al. | 428/158 |
| 4,281,598 | 8/1981 | Rump | 101/470 |
| 4,340,212 | 7/1982 | Simson | 270/5 |
| 4,501,072 | 2/1985 | Jacobi, Jr. et al. | 34/1 |
| 4,720,415 | 1/1988 | Vander Wielen et al. | 428/152 |
| 4,824,503 | 4/1989 | Wilen | 156/204 |
| 4,940,464 | 7/1990 | Van Gompel et al. | 604/396 |
| 4,965,122 | 10/1990 | Morman | 428/225 |
| 4,967,660 | 11/1990 | Yamanari et al. | 101/229 |
| 4,981,747 | 1/1991 | Morman | 428/198 |
| 5,086,700 | 2/1992 | Van Den Berg | 101/424.1 |
| 5,114,781 | 5/1992 | Morman | 428/198 |
| 5,116,662 | 5/1992 | Morman | 428/198 |
| 5,214,442 | 5/1993 | Roller | 346/1.1 |
| 5,226,992 | 7/1993 | Morman | 156/62.4 |
| 5,275,103 | 1/1994 | Hahne | 101/488 |
| 5,320,891 | 6/1994 | Levy et al. | 428/108 |
| 5,336,545 | 8/1994 | Morman | 428/152 |
| 5,456,176 | 10/1995 | Strasser | 101/219 |

OTHER PUBLICATIONS

USSN 08/338,986 to R. J. Schleinz et al., entitled "Ink--Printed, Low Basis Weight Nonwoven Fibrous Webs And Method" filed Nov. 14, 1994.

*Primary Examiner*—Christopher A. Bennett
*Attorney, Agent, or Firm*—Douglas L. Miller

[57] ABSTRACT

A low basis weight, continuously moving substrate is printed by a single substrate, repeat-pass printing process. The continuously moving substrate is passed a first time through the printing station without receiving any pattern directly printed thereon, and is then repeat-passed through the printing station and over a single-passing portion of the substrate. The repeat-pass portion then has an ink pattern directly printed thereon. Ink striking through the directly printed repeat-pass portion of the substrate is collected or absorbed by the underlying single-pass portion of the substrate, thereby preventing ink buildup on the printing apparatus.

12 Claims, 3 Drawing Sheets

SINGLE SUBSTRATE, REPEAT-PASS PRINTING PROCESS

BACKGROUND OF THE INVENTION

The present invention pertains to a process for printing substrates and substrates printed thereby, and more particularly to a single substrate, repeat-pass printing process and substrates printed thereby.

The ink printing of fabrics, such as woven and nonwoven fabrics, with various patterns and colors is well known. These printed fabrics are then incorporated into various products, such as personal care products. Examples of personal care products include diapers, training pants, incontinence products, and the like. The printed fabrics are primarily intended to aesthetically enhance the appearance of the products.

One problem with current ink printing processes is that the ink or inks can run through, i.e., strikethrough, the fabric, and particularly a low basis weight fabric. Low basis weight fabrics are generally thin, and inherently include a large number of small voids, or a smaller number of larger voids, through which the ink can strike through. The problem with ink strikethrough is that the ink builds up on, for example, an impression cylinder of the printing apparatus. This ink buildup on the impression cylinder results in poor print quality on the fabric, the transfer of ink to the back of the fabric, and poor operating efficiency due to machinery down time required to remove the ink buildup.

This problem becomes even more significant in high speed printing environments, where the ink buildup is accelerated and increases the number of times the machinery needs to be shut down for removal of the buildup. As the shut down times increase, so do waste of material and ink associated with machinery start-up.

One attempt to resolve ink buildup is the use of doctor blades on an impression roll or the like. Although doctor blades remove ink buildup while machinery is operating, their use prematurely wears out the surface of the cylinder or roll supporting the fabric. This, in turn, results in increased costs due to replacing prematurely worn out equipment.

Another attempt to eliminate ink buildup is to run a layer of material between the fabric and impression cylinder. The layer is designed to collect or absorb ink strikethrough and carry it away. This has proved to be costly, since either the layer must be replaced with a new layer, or the layer must be cleaned of the ink before being rerun through the printing apparatus.

SUMMARY OF THE INVENTION

In one form of the present invention there is provided a process for repeat-pass printing a substrate including providing a continuously moving substrate; single-passing a portion of the continuously moving substrate through a printing station without printing thereon; repeat-passing the portion of the continuously moving substrate back through the printing station and over another portion of the continuously moving substrate that is single-passing through the printing station; and printing ink on the portion of the continuously moving substrate that is repeat-passing through the printing station.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENTS

In many prior art processes for printing a substrate, portions of the ink applied to the substrate can pass through the substrate and become deposited on the surface of, for example, an impression cylinder. This is termed "strikethrough" and causes ink buildup on the impression cylinder. It is this strikethrough and ink buildup that results in poor print quality on the substrate, the transfer of ink to the back surface of the substrate, and poor operating efficiency due to machinery down time required to remove the ink buildup. Moreover, ink strikethrough causes various undesirable graphic effects on the substrate, such as the smearing of colors, blurring of the pattern, misregistration, or the like. These undesirable effects are not pleasing to the consumer, and tend to cause a perception of poor product quality and performance.

Figure 1:
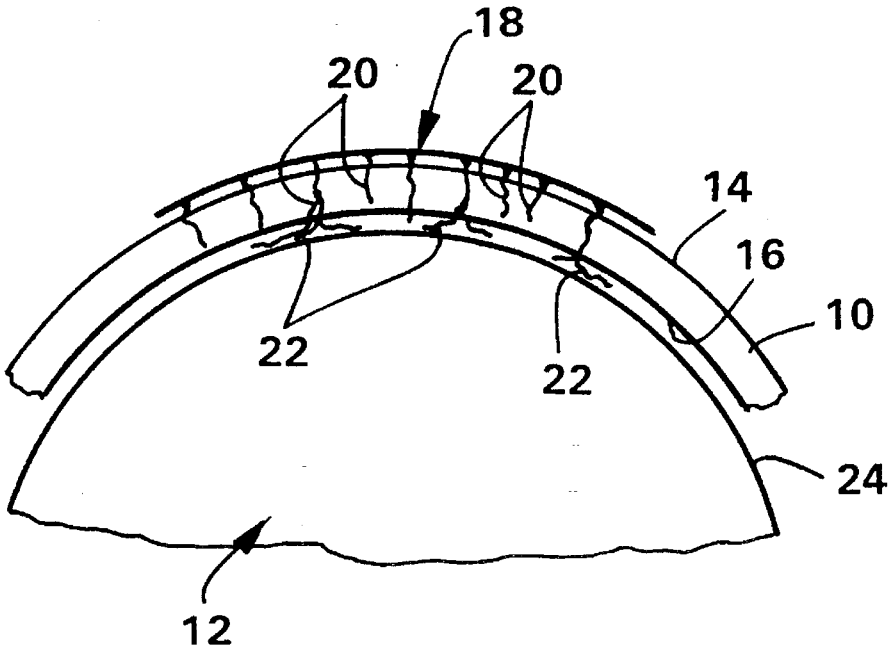
FIG. 1 (PRIOR ART)
FIG. 1 illustrates a fragmentary, cross-sectional view through a portion of one prior art printing apparatus.
Figure 2:
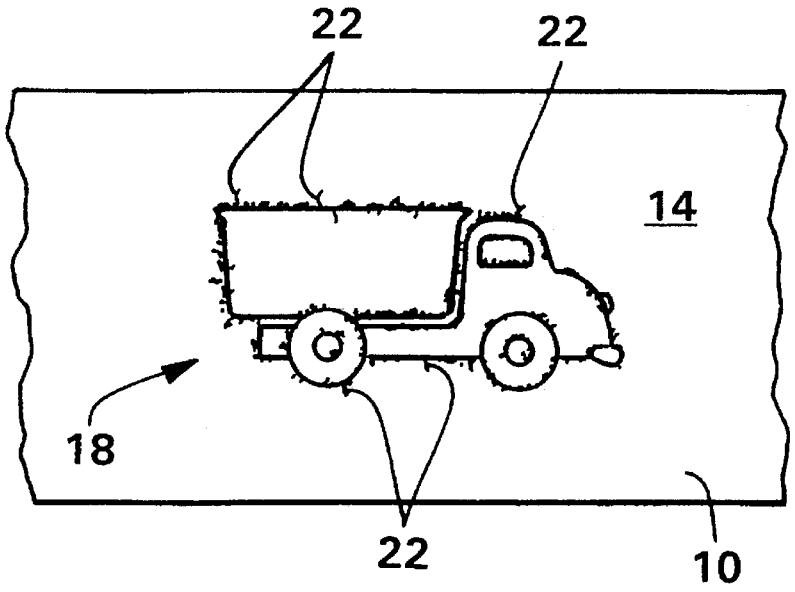
FIG. 2 (PRIOR ART)
FIG. 2 illustrates a fragmentary view of a low basis weight substrate printed by the apparatus of FIG. 1.

Referring to FIGS. 1–2, there is illustrated a prior art printing technique in which a substrate 10 is supported and transported by a central impression cylinder 12. The substrate 10 has a print surface 14 and a support surface 16. An ink pattern 18 has been printed on print surface 14 of substrate 10 by a series of print cylinders (not shown). Although FIG. 1 illustrates, for ease of explanation, substrate 10, cylinder 12, and ink pattern 18 as being slightly spaced apart, they are, in fact, in contact such that support surface 16 of substrate 10 is in contact with cylinder 12, and ink pattern 18 is in contact with print surface 14 of substrate 10.

An ink 20 (FIG. 1) has been printed on print surface 14 in order to form ink pattern 18. However, since substrate 10 has an inherent propensity for ink strikethrough and ink buildup on the printing apparatus, portions of ink 20 can pass through print surface 14 and through support surface 16. As a result, the ink can deposit as ink buildups 22 on surface 24 of central impression cylinder 12. It is this strikethrough that results in poor print quality on substrate 10, transfers ink onto support surface 16, and causes poor operating efficiency due to the machinery down time required to remove the ink buildup from cylinder 12. One example of a substrate 10 that has inherent propensity for ink strikethrough is a nonwoven substrate having a basis weight equal to or less than about 20 grams per square meter.

FIG. 2 illustrates the results that can occur in this prior art printing technique from ink buildup on the central impression cylinder 12. In FIG. 2, ink pattern 18 is in the form or design of a vehicle. The poor quality of ink pattern 18 is illustrated by the visible effect of ink 20 being deposited on the surface 24 of cylinder 12, and transferred onto support surface 16 (FIG. 1) of substrate 10. Ink strikethrough can cause various graphic effects, such as smearing of colors, blurring of the pattern, misregistration, or the like. Clearly, these are highly undesirable effects that are not aesthetically pleasing, and tend to cause a perception of poor product quality and performance.

Figure 3:
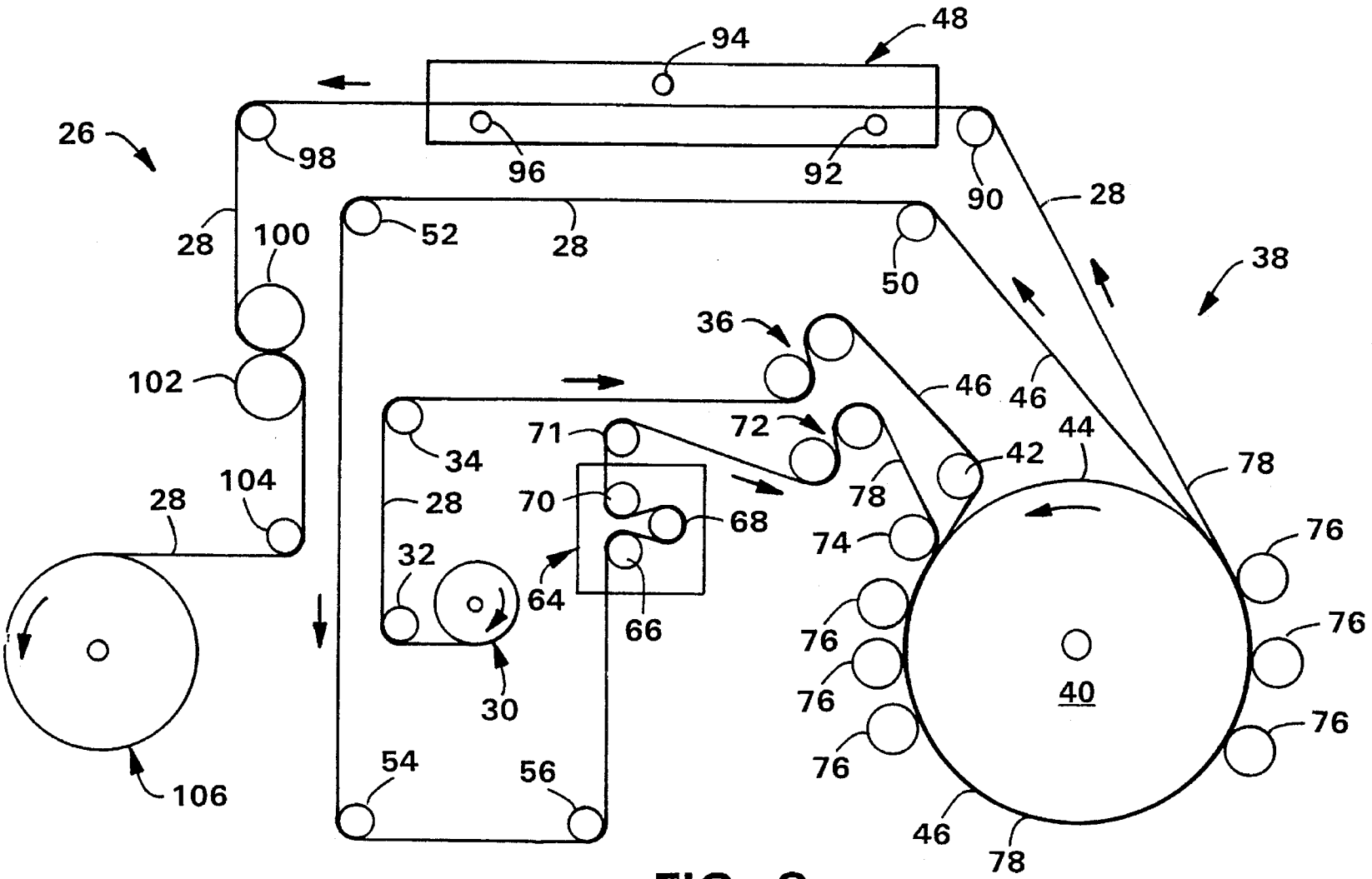
FIG. 3 illustrates schematically one apparatus operated in accordance with the principles of the present invention.

FIG. 3 illustrates an apparatus 26, which can be operated in accordance with the principles of the present invention, for printing a substrate by a repeat-pass process, such as a double-pass process, that can substantially eliminate ink buildup. The term "substrate" includes, but is not limited to, woven or nonwoven webs, porous films, ink permeable films, paper, or composite structures comprising a combination thereof. A nonwoven substrate is considered to be "low basis weight" when it has a basis weight equal to or less than about 20 grams per square meter (gsm). Other substrates, other than nonwoven substrates, are considered low basis weight if they have an inherent propensity for ink to strikethrough and cause ink buildup on the printing apparatus.

The term "pattern" when used with reference to printing herein, includes, but is not limited to, any type of design, mark, figure, identification code, graphic, word, image, or the like.

The present invention desirably utilizes a flexographic printing process to provide the proper balance of cost effectiveness, high speed, and high quality. The printing process is suitable for printing low basis weight substrates, such as low basis weight nonwoven webs, while maintaining the tactile softness of the substrates. Flexography is a printing technology which utilizes flexible raised rubber or photopolymer plates to carry the pattern to a given substrate. The flexible plates carry a typically low viscosity ink directly onto the substrate. Examples of suitable low viscosity inks include inks comprising a non-catalytic block urethane resin and a solvent blend comprising up to about 50% by volume of acetate and up to about 75% by volume of glycol ether. The solvent blend also may comprise up to about 10% by volume of alcohol.

Suitable acetates include ethyl acetate, N-propyl acetate, N-butyl acetate, i sopropyl acetate, i sobutyl acetate, butyl acetate, and blends thereof.

Suitable glycol ethers include ethylene glycol monopropyl ether, ethylene glycol monobutyl ether, diethylene glycol monomethyl ether, diethylene glycol monopropyl ether, propylene glycol monomethyl ether, and blends thereof.

Suitable alcohols include ethyl alcohol, isopropyl alcohol, N-propyl alcohol, and blends thereof.

A more detailed description of inks suitable for use with the present invention is contained in U.S. patent application Ser. No. 08/171,309, filed Dec. 20, 1993, which is assigned to the assignee of the present invention, the contents of which are incorporated by reference herein. Various flexographic printing presses are desirably used with the present invention, and two such designs include the central impression cylinder design and the stack-style design.

The types of plates that can be used with the flexographic process include plates identified as DuPont Cyrel® HL, PQS, HOS, PLS, and LP, which may be commercially obtained from E. I. DuPont de Nemours and Company, Inc., of Wilmington, Del. Other suitable plates can be commercially obtained from BASF of Clifton, N.J., and from W. R. Grace and Company of Atlanta, Ga.

Although flexographic printing is desired, other printing apparatus are also contemplated by the present invention. These other printing systems include screen printing, rotogravure printing in which an engraved print roll is utilized, and ink jet printing in which nozzles spray ink droplets that are selectively deflected by an electrostatic charge to form the desired pattern on the substrate. It is desirable that the inks used with these apparatus have a viscosity equal to or less than about 10 centipoise.

The single substrate, repeat-pass printing process of the present invention is a process that continuously prints substrates. One feature of the present invention is that only a single substrate is utilized and it serves as its own "back-up" material to substantially eliminate ink buildup on the printing apparatus. Thus, by eliminating ink buildup on the printing apparatus, the present invention improves the quality of the printed pattern, and reduces the costs of manufacture.

Referring to FIG. 3, a continuous supply of a moving substrate 28 is delivered from a primary unwind 30 over two idler rollers 32, 34 to a steering section 36. Steering section 36 maintains a proper lateral alignment of substrate 28 with a printing station 38, and more particularly with a rotatable central impression cylinder 40. From steering section 36, substrate 28 passes around a nip pressure roller 42 that holds or maintains substrate 28 in contact with a surface 44 of rotatable central impression cylinder 40.

Substrate 28 is transported through printing station 38 by rotatable central impression cylinder 40, and the first time through printing station 38, substrate 28 does not receive any ink pattern directly printed thereon by print cylinders 76. The portion of continuously moving substrate 28 that is passing through printing station 38 a first time without receiving any ink pattern directly printed thereon by print cylinders 76 is termed a single-pass portion 46.

From rotatable central impression cylinder 40, which can be rotated in any manner well known in the art, substrate 28 continues over a series of idler rollers 50, 52, 54, 56 and can loop around an unwind 30. The purpose of the idler rollers herein is to maintain substrate 28 on a proper path through apparatus 26. Because the present invention uses a single substrate in a repeat-pass manner, apparatus 26 can be operated within an optimum speed range desirably between about 500 to about 2,000 feet per minute, and can be operated for an extended period of time since shut-downs caused by ink buildup are substantially eliminated. Although not illustrated, a tension on substrate 28 can be controlled by electro-pneumatic dancer rolls or transducer rollers with feedback to speed control devices, as is well known in the art.

After passing idler roller 56, substrate 28 continues to a compensating roller section 64 having a series of compensating rollers 66, 68, 70. The operation and function of compensating roller section 64 is well known in the art of printing apparatus. One such compensating roller section 64 can be commercially obtained from Hurletron, Inc., of Danville, Ill. Compensating roller section 64 registers any strikethrough patterns on a single-pass portion 46 with a subsequent portion of substrate 28 that will be directly printed with an ink pattern; this registration step will be further described below. Thereafter, substrate 28 passes over an idler roller 71 to a second steering section 72 that laterally aligns substrate 28 with rotatable central impression cylinder 40. A nip pressure roller 74 holds or maintains substrate 28 between a single-pass portion 46 of substrate 28 and a series of print cylinders 76. There is illustrated, in FIG. 3, six print cylinders 76, with three on the left side and three on the right side of rotatable central impression cylinder 40. A fewer or greater number of print cylinders 76 can be utilized in accordance with the present invention, and individual ones of the print cylinders 76 can print colors that are the same or different from the colors printed by the other print cylinders 76.

Figure 4:
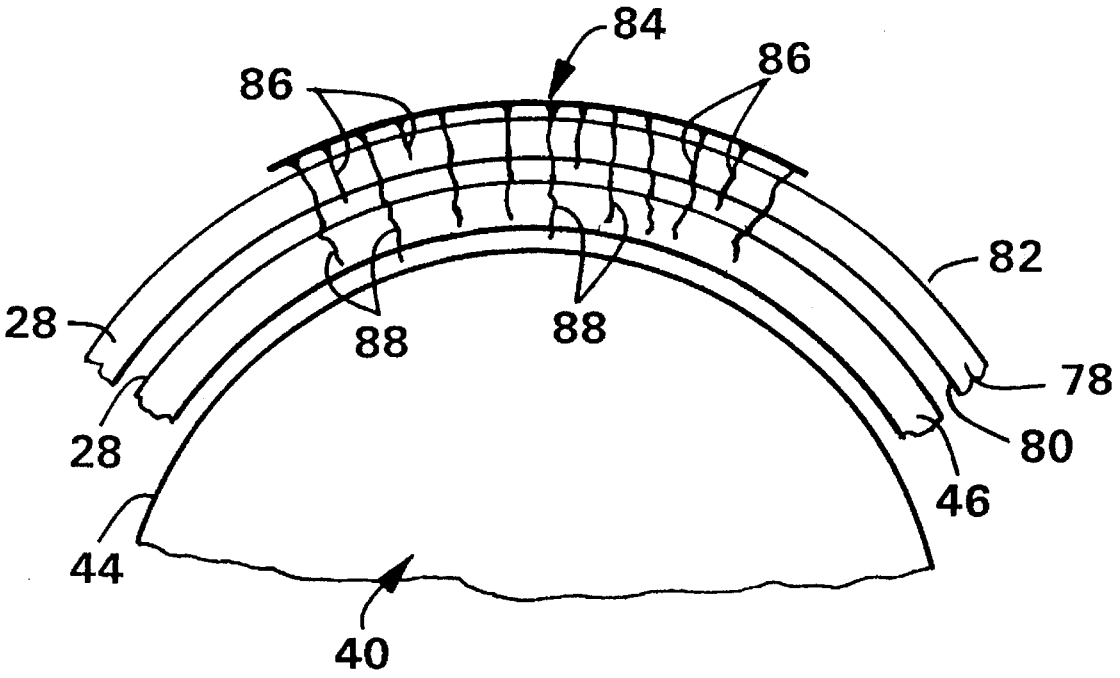
FIG. 4 illustrates a fragmentary, cross-sectional view through a portion of the central impression cylinder in FIG. 3.

Referring now to FIGS. 3 and 4, that portion of substrate 28 disposed between the single-pass portion 46 and print cylinders 76 is termed a double-pass portion 78, since it is on its second pass through the printing station 38. Although reference is made to a single-pass and a double-pass portion, the present invention contemplates that substrate 28 may repeat-pass through printing station 38 more than one time without having any ink pattern directly printed thereon. Various combinations of no direct printing and direct printing are contemplated by the present invention.

Referring primarily to FIG. 4, a single-pass portion 46 of substrate 28 is disposed between surface 44 of central impression cylinder 40 and the double-pass portion 78 of substrate 28. Double-pass portion 78 includes a support surface 80 adjacent single-pass portion 46, and a print surface 82 facing toward print cylinders 76 (FIG. 3). Print cylinders 76 then print an ink pattern 84 on print surface 82. As illustrated in FIG. 4, the ink 86, or inks, penetrates through the spaces or voids (not shown) in double-pass portion 78 of substrate 28. Because substrate 28 is a low basis weight material as defined herein, ink 86 can run or strikethrough double-pass portion 78. The ink strikethrough 88 passing through a double-pass portion 78 is collected or absorbed by the underlying single-pass portion 46, thereby preventing ink buildup on surface 44 of cylinder 40.

After passing through printing station 38, substrate 28 continues to a tunnel 48 and over a series of idler rollers 90, 92, 94, 96, 98. In tunnel 48, substrate 28 is subjected to a temperature and airflow suitable for drying the substrate and the ink printed thereon. Alternatively, tunnel 48 can be a radiation curing unit to be used in conjunction with radiation curable inks. Examples of radiation curing methods include ultraviolet curing, electron beam curing, infrared curing, and the 1 i ke.

After passing through tunnel 48, substrate 28 proceeds to a pair of chill rollers 100, 102 that cool substrate 28 in order to reduce substrate temperature to ambient.

Thereafter, substrate 28 passes over idler roller 104 to a primary rewind 106 that rewinds printed substrate 28 for subsequent transporting and handling.

Figure 5:
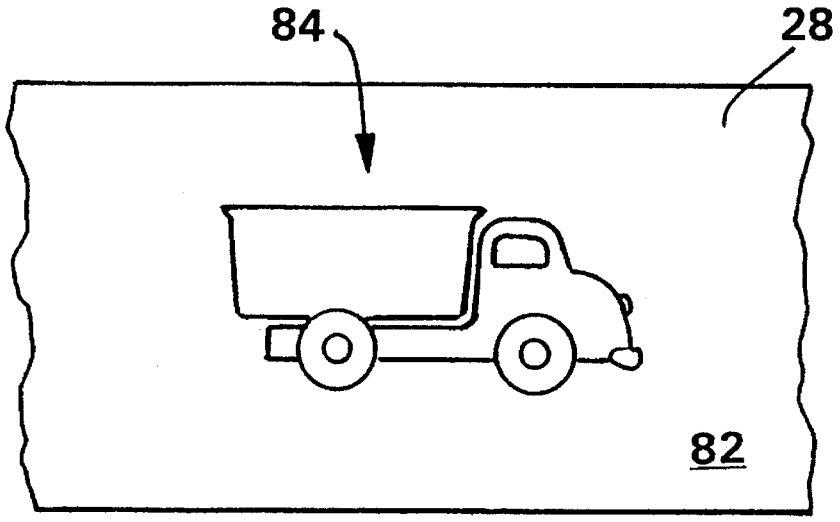
FIG. 5 illustrates a fragmentary view of a low basis weight substrate printed in accordance with the principles of the present invention.

Referring to FIG. 5, substrate 28 is illustrated with ink pattern 84 printed thereon. In contrast to ink pattern 18 (FIG. 2) with its visually perceivable ink buildups 22, the present invention provides an ink pattern free of visually perceivable ink buildups.

Depending upon the ink used to print an ink pattern, and the material of which substrate 28 is comprised, the ink strikethrough 88 (FIG. 4) on a single-pass portion 46 may or may not be visually discernible to the naked eye. However, if ink strikethrough 88 is visually discernible on a single-pass portion 46, compensating roller section 64 (FIG. 3) can register that ink pattern that has struck through on a single-pass portion 46 with an ink pattern 84 that will be directly printed on that portion 46 as it proceeds a second time through printing station 38 as a double-pass portion 78. An ink strikethrough 88, along with its color or colors, match that of a directly printed ink pattern 84. By registering an ink strikethrough 88, the clarity and definition of ink pattern 84 is preserved, and undesirable ghost images in unprinted areas are substantially eliminated.

As described earlier, substrate 28 can be a woven or nonwoven web or fabric, and desirably can be a polyolefin-based web. Polyolefin-based webs include, but are not limited to, woven materials, nonwoven materials, knits and porous films which employ polyolefin-based polymers. Examples of such polyolefins are polypropylene and polyethylene, including low density, high density, and linear low density polyethylene.

It should be appreciated, however, that the present invention is not limited to these types of polyolefins, but embraces all types of polymers, copolymers, and natural fibers. In woven material applications, these materials can be made into continuous fibers, which are in turn woven into a fabric. In nonwoven applications, the fibers may be long, generally continuous fibers, such as spunbond fibers, or they may be shorter staple length fibers, such as are commonly used in carded webs. The fibers may also be meltblown to form the desired web. Such polymers or copolymers may be extruded, cast, or blown into films for subsequent use according to the present invention. Other nonwovens suitable for use with the present invention include airlaid, wet laid, solution spun fiber webs, or the like.

Fibers used in accordance with the present invention can be "straight" fibers in that they have the same general polymer or copolymer composition throughout. The fibers may also be multipolymer or multicomponent fibers, such as bicomponent fibers in which at least one component is a polyolefin, such as a polyolefin sheath and a polypropylene core fiber, or a polyethylene sheath and a polyester core fiber. In addition to sheath/core fiber configurations, other examples of suitable fiber cross-sections are side-by-side, sea-in-islands, and eccentric fiber configurations. Furthermore, fibers with non-circular cross-sections such as "Y" and "X" shapes may be used.

The fibers and/or webs may have other components and/or treatments. For example, adhesives, waxes, flow modifiers, processing aids, and other additives may be used during the formation of the fibers or webs. In addition, pigments may be added to the fibers to change their color and other additives may be incorporated into the compositions to make the fibers or webs elastic. Lastly, blends of fibers, as well as straight and bicomponent fibers, may be combined to form nonwoven or woven webs suitable for use with the present invention.

The printed substrate can be used by itself, or in a multilayer configuration such as a laminate of one or more film and/or woven and/or nonwoven layers. Examples of such multilayer configurations include film/nonwoven laminates, or nonwoven/nonwoven laminates such as a spunbond/meltblown/spunbond three-layer laminate. By using such multilayer configurations, a variety of properties can be imparted to the laminate including breathability and/or liquid imperviousness.

When forming a nonwoven, such as a nonwoven polyolefin fibrous web, the fiber size and basis weight of the material can be varied according to the particular end use. In personal care products and medical fabric usage, typical fiber sizes will range from between about 0.1 to about 10 denier.

While this invention has been described as having a preferred embodiment, it will be understood that it is capable of further modification. This application is thereby intended to cover any variations, equivalents, uses, or adaptations of the invention following the general principles thereof, and including such departures from the present disclosure as come or may come within known or customary practice in the art to which this invention pertains and fall within the limits of the appended claims.

What is claimed is:

1. A single substrate, repeat-pass printing process, comprising:

providing a continuously moving substrate, single-passing a portion of the continuously moving substrate through a printing station without directly printing thereon, repeat-passing the portion of the continuously moving substrate back through the printing station and over another portion of the continuously moving substrate that is single passing through the printing station, and printing ink on the portion of the continuously moving substrate that is repeat-passing through the printing station.

2. The process of claim 1 further comprising collecting on the single-passing portion ink striking through the repeat-passing portion.

3. The process of claim 1 further comprising registering the repeat-passing portion and the single-passing portion.

4. The process of claim 1 further comprising laterally aligning the continuously moving substrate with the printing station.

5. The process of claim 1 further comprising drying the substrate.

6. The process of claim 1 further comprising cooling the substrate.

7. The process of claim 1 further comprising radiation curing the substrate.

8. The process of claim 1 wherein the printing is flexographic printing.

9. The process of claim 1 wherein the printing is rotogravure printing.

10. The process of claim 1 wherein the printing is ink-jet printing.

11. The process of claim 1 wherein the substrate has a basis weight equal to or less than about 20 grams per square meter.

12. The process of claim 1 wherein the substrate is a nonwoven fibrous web.

* * * * *